US009472835B2

(12) United States Patent
Zhou

(10) Patent No.: US 9,472,835 B2
(45) Date of Patent: Oct. 18, 2016

(54) FILTERING APPARATUS

(71) Applicant: Huawei Technologies Co., Ltd., Shenzhen (CN)

(72) Inventor: Yanzhao Zhou, Milan (IT)

(73) Assignee: Huawei Technologies Co., Ltd., Shenzhen (CN)

( * ) Notice: Subject to any disclaimer, the term of this patent is extended or adjusted under 35 U.S.C. 154(b) by 123 days.

(21) Appl. No.: 14/513,659

(22) Filed: Oct. 14, 2014

(65) Prior Publication Data

US 2015/0061793 A1 Mar. 5, 2015

Related U.S. Application Data

(63) Continuation of application No. PCT/CN2012/082717, filed on Oct. 10, 2012.

(30) Foreign Application Priority Data

May 16, 2012 (CN) ..... 2012 1 0152024

(51) Int. Cl.
*H01P 1/202* (2006.01)
*H01P 1/205* (2006.01)
*H01P 1/213* (2006.01)

(52) U.S. Cl.
CPC ..... *H01P 1/202* (2013.01); *H01P 1/205* (2013.01); *H01P 1/2136* (2013.01)

(58) Field of Classification Search
CPC .. H01P 1/205; H01P 1/20309; H01P 1/2053; H01P 1/2056; H01P 1/2133; H01P 1/2136; H01P 7/04; H01P 7/10; H01P 7/105
USPC ..... 333/125, 126, 129, 134, 136, 206, 207, 333/202, 203, 219.1, 222–226
See application file for complete search history.

(56) References Cited

U.S. PATENT DOCUMENTS 4,216,448 A 8/1980 Kasuga et al.
5,977,848 A 11/1999 Nakaguchi et al.
(Continued)

FOREIGN PATENT DOCUMENTS

CN 1082789 A 2/1994
CN 1192592 A 9/1998
(Continued)

OTHER PUBLICATIONS

Partial English Translation and Abstract of Chinese Patent Application No. CN1082789A, Dec. 31, 2014, 9 pages.
(Continued)

*Primary Examiner* — Robert Pascal
*Assistant Examiner* — Gerald Stevens
(74) *Attorney, Agent, or Firm* — Conley Rose, P.C.; Grant Rodolph; Nicholas K. Beaulieu

(57) ABSTRACT

A filtering apparatus includes a passband of a first-level unit which is formed by at least three coaxial filters covers a passband of a second-level unit which is formed by at least three dielectric filters, and a bandwidth of the first-level unit is twice the bandwidth of the second-level unit, so that when the coaxial filters are coupled to the dielectric filters, insertion loss of the coaxial filters is reduced, thereby reducing overall insertion loss of the filtering apparatus. By making a transmission zero of the first-level unit be located at a second harmonic frequency point of the second-level unit, the filtering apparatus can have high suppression on a second harmonic, thereby obtaining relatively desirable far-end suppression performance.

10 Claims, 8 Drawing Sheets

(56) References Cited

U.S. PATENT DOCUMENTS

| | | | | |
|---|---|---|---|---|
| 6,060,965 | A | 5/2000 | Sung et al. | |
| 7,738,853 | B2 * | 6/2010 | Eddy | H01P 1/2053 330/303 |
| 2008/0018418 | A1 | 1/2008 | Zhao | |
| 2012/0019338 | A1 | 1/2012 | Blair | |

FOREIGN PATENT DOCUMENTS

| | | | |
|---|---|---|---|
| CN | 1901273 | A | 1/2007 |
| CN | 2881984 | Y | 3/2007 |
| CN | 201725861 | U | 1/2011 |
| CN | 102324602 | A | 1/2012 |
| CN | 202103148 | U | 1/2012 |
| CN | 102694220 | A | 9/2012 |
| EP | 1732158 | A1 | 12/2006 |

OTHER PUBLICATIONS

Partial English Translation and Abstract of Chinese Patent Application No. CN102694220A, Part 1, Nov. 24, 2014, 11 pages.

Partial English Translation and Abstract of Chinese Patent Application No. CN102694220A, Part 2, Nov. 24, 2014, 4 pages.

Foreign Communication From a Counterpart Application, Chinese Application No. 201210152024.X Chinese Office Action dated Oct. 10, 2013, 5 pages.

Foreign Communication From A Counterpart Application, PCT Application No. PCT/CN2012/082717, English Translation of International Search Report dated Feb. 28, 2013, 3 pages.

Foreign Communication From A Counterpart Application, PCT Application No. PCT/CN2012/082717, English Translation of Written Opinion dated Feb. 28, 2013, 6 pages.

Hwang, H., et al., "The Design of Band-Pass Filters Made of Both Dielectric and Coaxial Resonators," WE3F-14, IEEE TT-S Digest, Jun. 8, 1997, 4 pages.

Knack, A., et al., "Dielectric Resonator Filters for UMTS Systems," IEEE MTT-S International Microwave Workshop Series on Art of Miniaturizing RF and Microwave Passive Components, Dec. 14, 2008, pp. 30-33.

Foreign Communication From A Counterpart Application, European Application No. 12876853.8 Extended European Search Report dated Jan. 22, 2015, 9 pages.

* cited by examiner

FILTERING APPARATUS

CROSS-REFERENCE TO RELATED APPLICATIONS

This application is a continuation of International Application No. PCT/CN2012/082717, filed on Oct. 10, 2012, which claims priority to Chinese Patent Application No. 201210152024.X, filed on May 16, 2012, both of which are hereby incorporated by reference in their entireties.

TECHNICAL FIELD

The present invention relates to the field of mobile communications technologies, and in particular, to a filtering apparatus.

BACKGROUND

Filters are widely applied in mobile communications systems. For example, a duplexer of a transceiver module of a base station is formed by radio frequency (RF) cavity filters, which are located on a structural part on the back of a transceiver board and are configured to transmit a single channel of high-power radio frequency signal. The cavity filter generally uses a coaxial filter with a coaxial cavity.

As mobile communications technologies develop toward multiband, a coaxial filter gradually fails to meet the requirement of mobile communications systems for low insertion loss. The emergence of a traverse electric wave 01 (TE01) mode dielectric filter with a dielectric cavity solves this problem. The TE01 mode dielectric filter is formed by a TE01 mode dielectric resonator working in a TE01 mode. Since the TE01 mode dielectric resonator is made by using high power factor (Q) microwave dielectric ceramic, the TE01 mode dielectric filter has relatively low insertion loss and meets the requirement of mobile communications systems for low insertion loss, and therefore has been developed for commercial use.

However, it is found in the process of using the TE01 mode dielectric filter that the distance between a high-order harmonic wave and a passband of the TE01 mode dielectric filter is approximately 200-400 megahertz (MHz); therefore, suppression on a high-order harmonic wave at a far end of the TE01 mode dielectric filter is less than 70 decibels (dB), and performance of far-end suppression is relatively undesirable. For a dielectric filter, the far end refers to a frequency that exceeds a high frequency end of above 100 MHz of a passband.

To correct the foregoing defects of the TE01 mode dielectric filter, two solutions are provided in the prior art. One solution is to add a metal resonator at a port of the TE01 mode dielectric filter. This solution can increase the distance between a high-order harmonic frequency and a passband, but suppression on a high-order harmonic wave still cannot meet the requirement and insertion loss is relatively high. The other solution is to add a low-pass filter at the front of the TE01 mode dielectric filter. This solution can increase suppression on a high-order harmonic wave of a relatively high frequency. However, a stopband of the low-pass filter is smooth and is not steep, and therefore, for a high-order harmonic wave at a distance of approximately 200-400 MHz from the passband, relatively high suppression cannot be obtained and insertion loss is relatively high.

SUMMARY

Embodiments of the present invention provide a filtering apparatus, which can reduce insertion loss and achieve relatively desirable far-end suppression performance.

To achieve the foregoing objective, the following technical solutions are adopted in the embodiments of the present invention.

A filtering apparatus includes a first-level unit and a second-level unit, where the first-level unit is formed by at least three coaxial filters, the coaxial filters are arranged in sequence, each coaxial filter is coupled to an adjacent coaxial filter in an arrangement direction, and two nonadjacent coaxial filters in the arrangement direction in the at least three coaxial filters are inductively coupled, so as to generate a transmission zero at a high frequency end of a passband of the first-level unit; the second-level unit is formed by at least three dielectric filters, the dielectric filters are arranged in sequence, each dielectric filter is coupled to an adjacent dielectric filter in an arrangement direction; a coaxial filter that is arranged last in the first-level unit is coupled to a dielectric filter that is arranged first in the second-level unit; the passband of the first-level unit covers a passband of the second-level unit, and a bandwidth of the first-level unit is twice the bandwidth of the second-level unit; and the transmission zero of the first-level unit is located at a second harmonic frequency point of the second-level unit.

In the filtering apparatus provided in the embodiments of the present invention, a passband of a first-level unit that is formed by at least three coaxial filters covers a passband of a second-level unit that is formed by at least three dielectric filters, and a bandwidth of the first-level unit is twice the bandwidth of the second-level unit, so that when the coaxial filters are coupled to the dielectric filters, insertion loss of the coaxial filters is reduced, thereby reducing overall insertion loss of the filtering apparatus. By making a transmission zero of the first-level unit be located at a second harmonic frequency point of the second-level unit, the filtering apparatus can have high suppression on a second harmonic wave, thereby obtaining relatively desirable far-end suppression performance.

BRIEF DESCRIPTION OF THE DRAWINGS

To describe the technical solutions in the embodiments of the present invention more clearly, the following briefly introduces the accompanying drawings required for describing the embodiments. The accompanying drawings in the following description show merely some embodiments of the present invention, and a person of ordinary skill in the art may still derive other drawings from these accompanying drawings without creative efforts.

DETAILED DESCRIPTION

The following clearly describes the technical solutions in the embodiments of the present invention with reference to the accompanying drawings in the embodiments of the present invention. The described embodiments are merely a part rather than all of the embodiments of the present invention. All other embodiments obtained by a person of ordinary skill in the art based on the embodiments of the present invention without creative efforts shall fall within the protection scope of the present invention.

Figure 1:
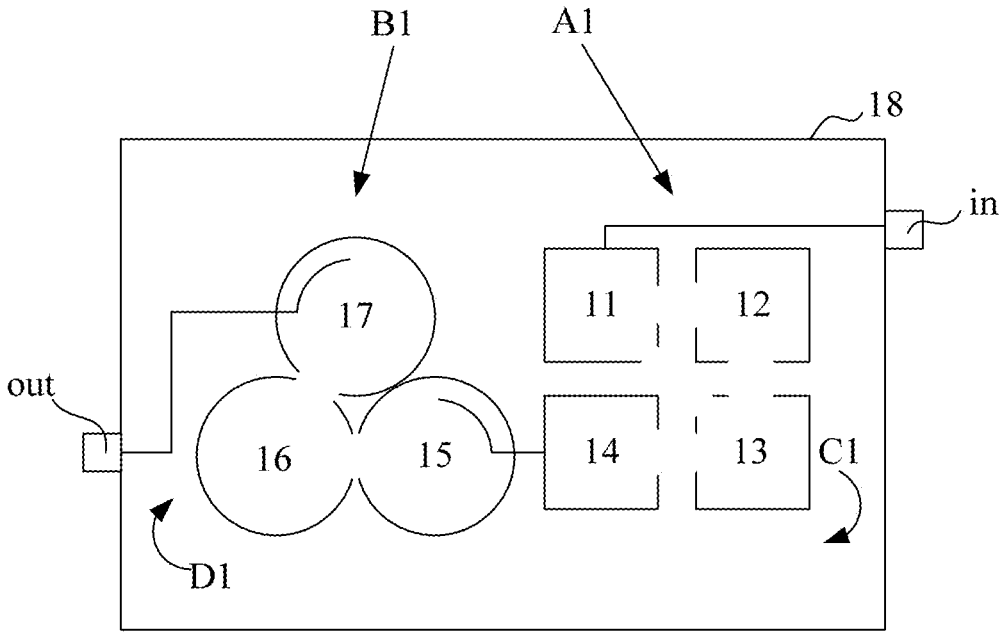
FIG. 1 is a schematic structural diagram of a filtering apparatus according to an embodiment of the present invention.

An embodiment of the present invention provides a filtering apparatus. As shown in FIG. 1, the apparatus includes a first-level unit A1 and a second-level unit B1.

The first-level unit A1 is formed by at least three coaxial filters 11, 12, 13, and 14, and the coaxial filters 11, 12, 13, and 14 are arranged in sequence, for example, arranged in a sequence of 11→12→13→14, so as to form an arrangement direction C1. Each coaxial filter is coupled to an adjacent coaxial filter in the arrangement direction C1, that is, the coaxial filter 11 is coupled to the coaxial filter 12, the coaxial filter 12 is coupled to the coaxial filter 13, and the coaxial filter 13 is coupled to the coaxial filter 14.

Figure 2:
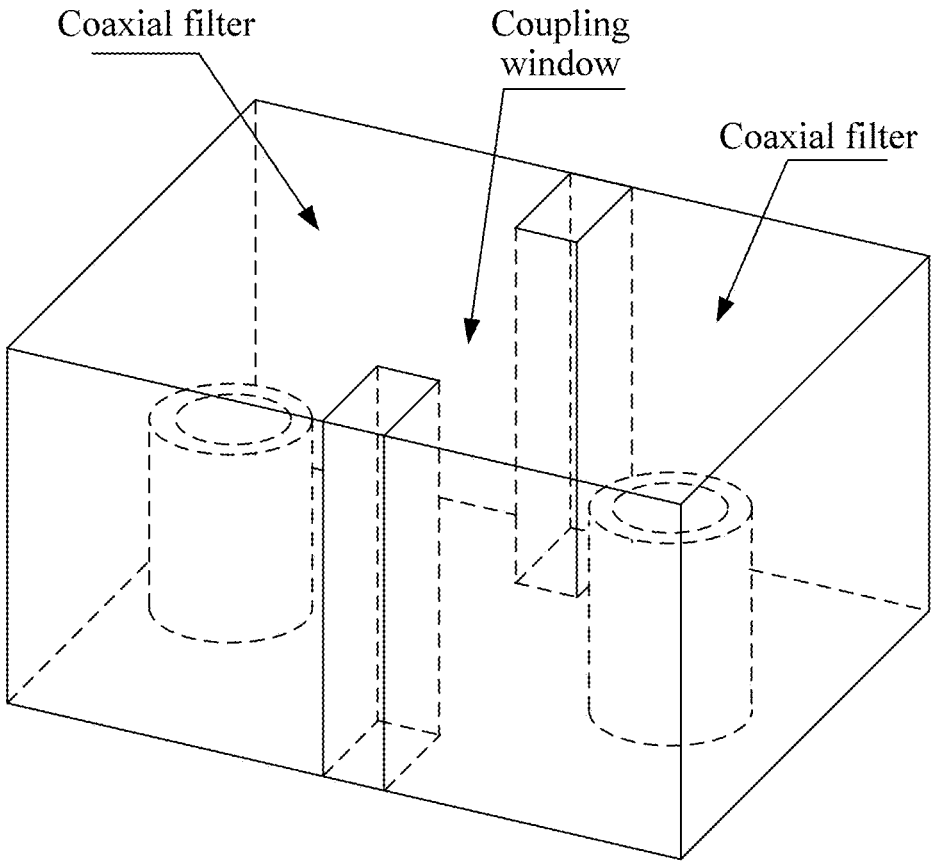
FIG. 2 is a space diagram of two coaxial filters being coupled by using a coupling window according to an embodiment of the present invention.

A coupling manner of the coaxial filters may be coupling by using coupling windows as shown in FIG. 1, and the coupling windows are formed on side walls of metal cavities of coaxial filters. Coupling may also be implemented in other manners, for example, coupling by using a coupling loop. FIG. 2 shows a case in which two coaxial filters are coupled by using a coupling window.

Two nonadjacent coaxial filters in the arrangement direction C1 in the at least three coaxial filters 11, 12, 13, and 14 are inductively coupled. For example, the coaxial filter 11 and the coaxial filter 13 are two nonadjacent coaxial filters in the arrangement direction C1, and the coaxial filter 12 and the coaxial filter 14 are also two nonadjacent coaxial filters in the arrangement direction C1. According to a transmission phase characteristic of a filter, by means of inductive coupling of the coaxial filters, on the right side of a passband of the first-level unit, namely, a high frequency end of the passband, a transmission zero is generated.

Therefore, by enabling the coaxial filter 11 to be inductively coupled to the coaxial filter 13, or enabling the coaxial filter 12 to be inductively coupled to the coaxial filter 14, a transmission zero is generated at the high frequency end of the passband of the first-level unit A1. The transmission zero is a frequency point with the highest suppression, and an electromagnetic wave with the frequency point cannot pass the first-level unit A1.

Two nonadjacent coaxial filters that is in the arrangement direction and configured to generate the transmission zero at the high frequency end of the passband of the first-level unit A1 may be coupled by using a coupling window, and may also be coupled in other manners, for example, coupled by using a coupling loop. As shown in FIG. 1, a coupling window is formed between the coaxial filter 11 and the coaxial filter 13. The size of the coupling window determines the location of the transmission zero.

The second-level unit B1 is formed by at least three dielectric filters 15, 16, and 17, so that the second-level unit B1 forms a band-pass filter with a certain bandwidth. The dielectric filters are arranged in sequence, for example, arranged in a sequence of 15→16→17, so as to form an arrangement direction D1. Each dielectric filter is coupled to an adjacent dielectric filter in the arrangement direction D1.

Figure 3:
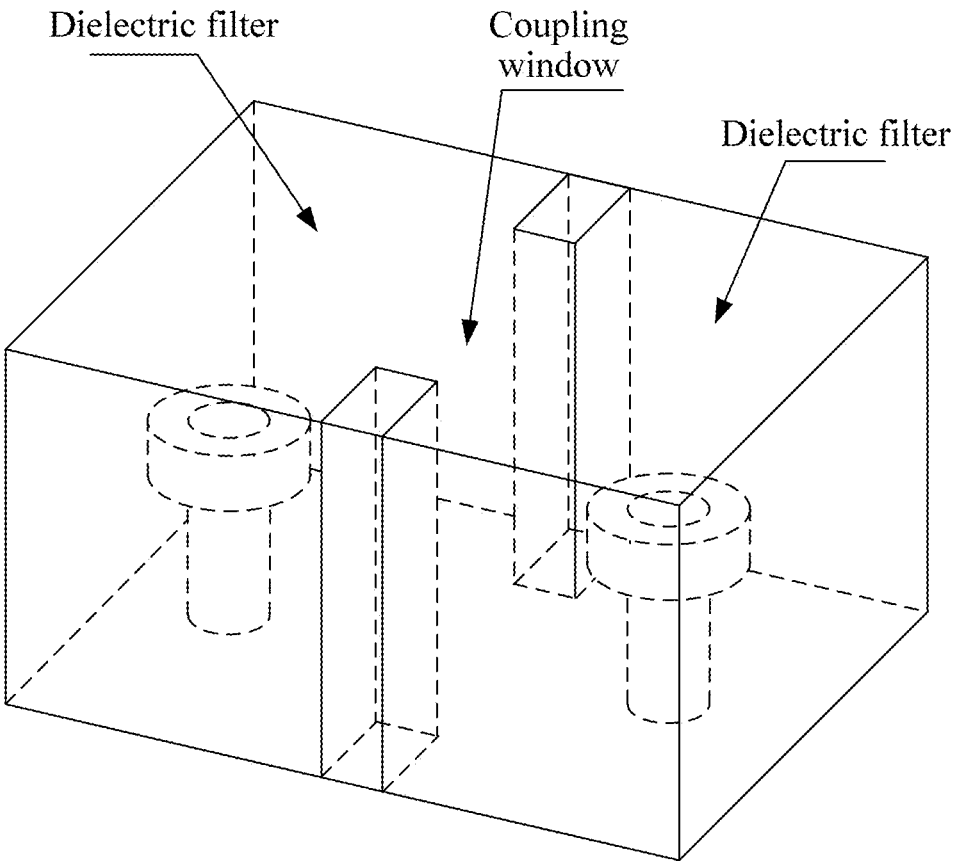
FIG. 3 is a space diagram of two dielectric filters being coupled by using a coupling window according to an embodiment of the present invention.

A coupling manner of the dielectric filters may be coupling by using coupling windows as shown in FIG. 1, and the coupling windows are formed on side walls of metal cavities of the dielectric filters. Coupling may also be implemented in other manners, for example, coupling by using a coupling loop. FIG. 3 shows a case in which two dielectric filters are coupled by using a coupling window.

The coaxial filter 14 that is arranged last in the first-level unit A1 is coupled to the dielectric filter 15 that is arranged first in the second-level unit B1.

A coupling manner of the coaxial filter 14 and the dielectric filter 15 may be coupling by using a coupling loop as shown in FIG. 1, and may also be coupled in other manners, for example, coupled by using a coupling window. Coupling using a coupling loop has the maximum coupling strength.

The passband of the first-level unit A1 covers a passband of the second-level unit B1, and a bandwidth of the first-level unit A1 is twice the bandwidth of the second-level unit B1.

A unit formed by at least three coaxial filters or at least three dielectric filters is a band-pass filter, that is, both the first-level unit A1 and the second-level unit B1 are band-pass filters. Assuming that the passband of the second-level unit B1 is 1610 MHz-1630 MHz and the bandwidth is 20 MHz, the passband of the first-level unit A1 may be designed as 1600 MHz-1640 MHz and the bandwidth is 40 MHz, namely, twice the bandwidth of the second-level unit B1.

The first-level unit is designed in this manner, so that when the first-level unit is coupled to the second-level unit, that is, when the coaxial filters are coupled to the dielectric filters, insertion loss of the coaxial filters is reduced, thereby decreasing overall insertion loss of the filtering apparatus.

The transmission zero of the first-level unit A1 shown in FIG. 1 is located at a second harmonic frequency point of the second-level unit B1. As described above, the transmission zero is generated after two nonadjacent coaxial filters in the arrangement direction C1 are inductively coupled, and the transmission zero is a frequency point with the highest suppression. If the transmission zero is located at the second harmonic frequency point of the second-level unit B1, an electromagnetic wave with the second harmonic frequency point cannot pass the filtering apparatus, that is, the electromagnetic wave with the second harmonic frequency point is filtered by the filtering apparatus. For example, when the second harmonic frequency point of the second-level unit B1 is 2740 MHz, the transmission zero of the first-level unit A1 is designed as 2740 MHz.

For the second-level unit B1 formed by a plurality of dielectric filters, suppression on a second harmonic wave is far-end suppression, and it is proved by tests that by enabling the transmission zero of the first-level unit A1 to be located at the second harmonic frequency point of the second-level unit B1, suppression of the filtering apparatus on the second harmonic wave is above 80 dB, thereby achieving desirable far-end suppression performance.

The filtering apparatus further includes a housing 18 that house the first-level unit and the second-level unit. Two coaxial connectors are arranged on the housing 18, where a coaxial connector in is a signal input end and is connected to the coaxial filter 11 that is arranged first of the first-level unit A1. A coaxial connector out is a signal output end and is connected to the dielectric filter 17 that is arranged last of the second-level unit B1.

Figure 4:
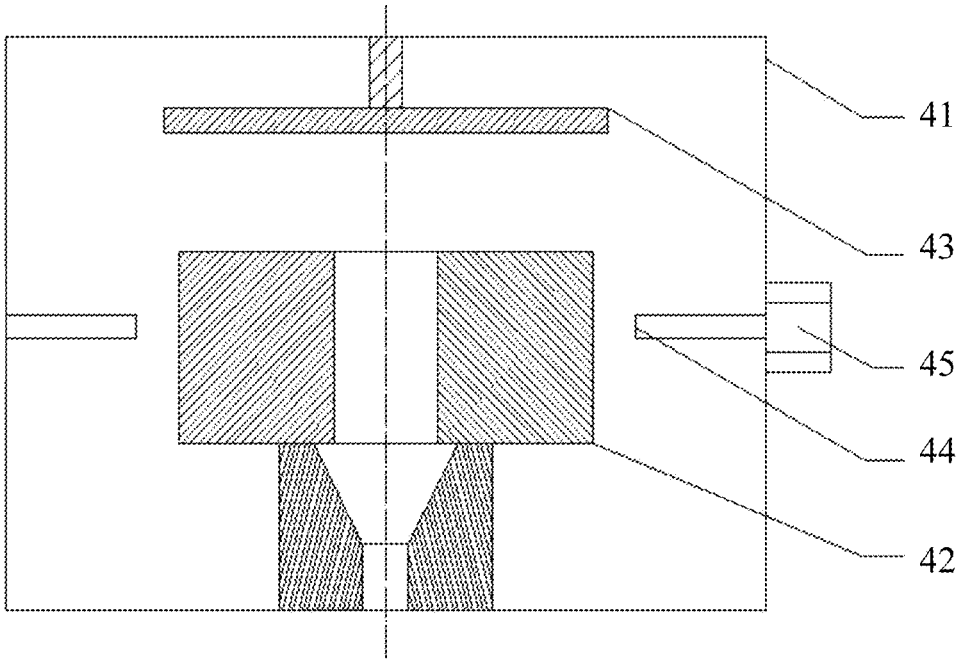
FIG. 4 is a sectional view of a dielectric filter used in a filtering apparatus according to an embodiment of the present invention.

FIG. 4 is a sectional view of a dielectric filter with a typical structure. The dielectric filter includes a metal cavity 41, a dielectric resonator 42 fastened at the bottom of the metal cavity 41, and a dielectric tuner 43 fastened at the top of the metal cavity 41, where the dielectric tuner 43 is opposite to the dielectric resonator 42, when the dielectric tuner 43 moves towards the bottom or the top of the metal cavity 41, the distance from the dielectric resonator 42 is decreased or increased, so as to adjust a resonance frequency of the dielectric resonator 42, and a coupling window (not shown in FIG. 4) is formed on a side wall of the metal cavity 41. FIG. 4 shows a dielectric filter that is arranged first in a second-level unit. Therefore, a coupling loop 44 is arranged on a side wall, where a coupling window is not arranged, of the metal cavity 41, and the coupling loop 44 is connected to a coaxial connector 45 on an external wall of the metal cavity 41.

Figure 5:
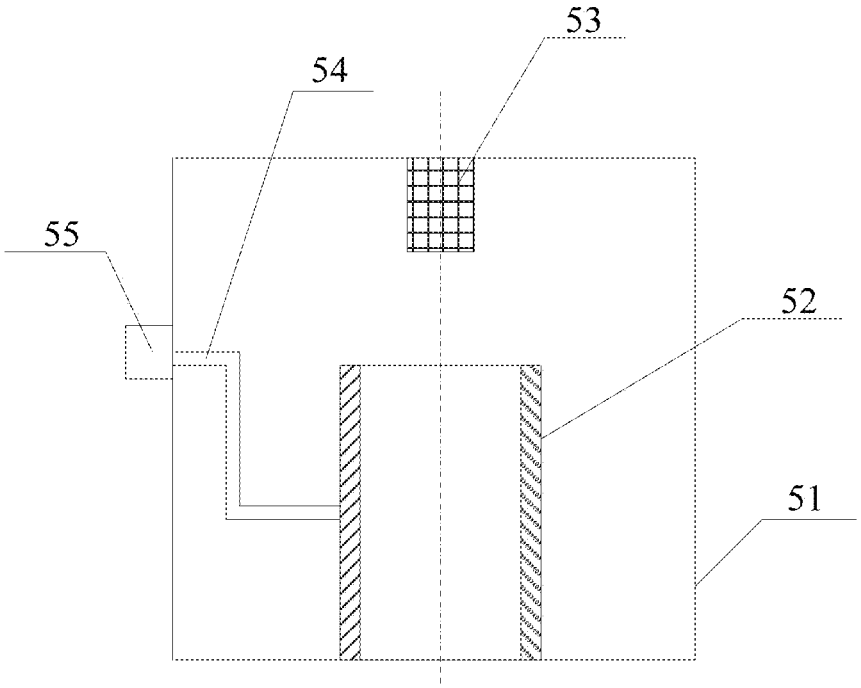
FIG. 5 is a sectional view of a coaxial filter used in a filtering apparatus according to an embodiment of the present invention.

FIG. 5 is a sectional view of a coaxial filter with a typical structure. The coaxial filter includes a metal cavity 51, a conductor 52 that is fastened at the bottom of the metal cavity 51 and coaxial with the metal cavity 51, and a tuning screw 53 fastened at the top of the metal cavity 51, where the tuning screw 53 is opposite to the conductor 52, when the tuning screw 53 moves towards the bottom or the top of the metal cavity 51, the distance from the conductor 52 is decreased or increased, so as to adjust a reflection delay of the coaxial filter, and a coupling window (not shown in FIG. 5) is formed on a side wall of the metal cavity 51. The coaxial filter shown in FIG. 5 is a coaxial filter that is arranged last in a first-level unit. Therefore, a coupling tap 54 is further arranged on a side wall, where a coupling window is not arranged, of the metal cavity 51, and the coupling tap 54 is connected to a coaxial connector 55 on an external wall of the metal cavity 51.

Figure 6:
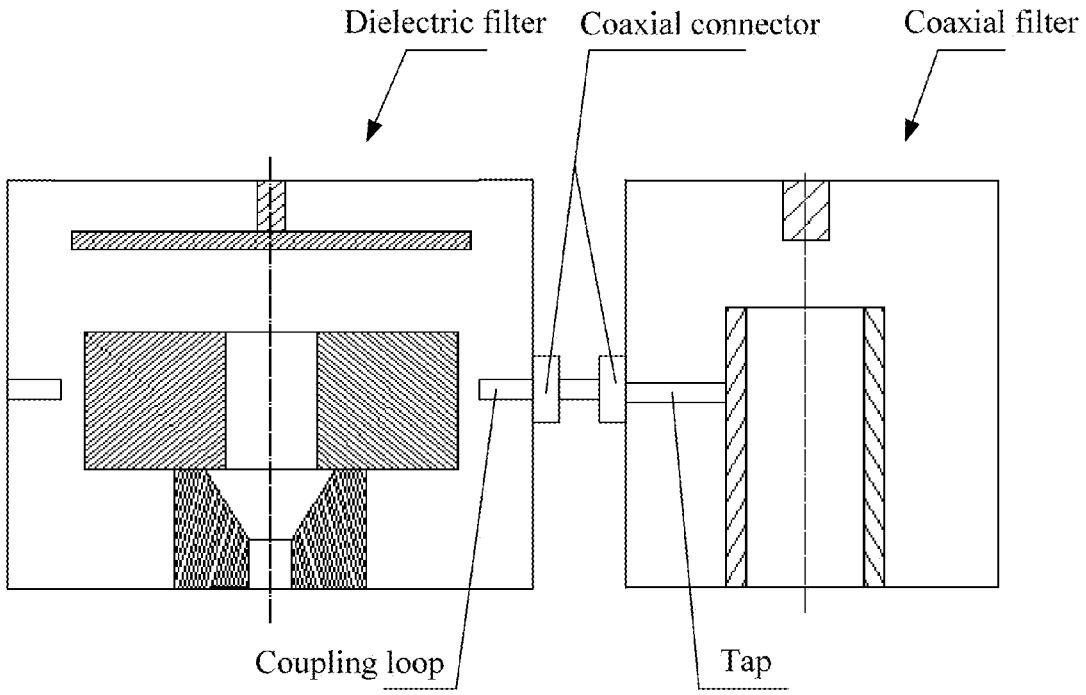
FIG. 6 is a sectional view of coupling by using a coupling loop formed after a coaxial filter that is arranged last in a first-level unit is connected to a dielectric filter that is arranged first in a second-level unit in a filtering apparatus according to an embodiment of the present invention.

FIG. 6 is a schematic diagram of coupling by using a coupling loop formed after the dielectric filter shown in FIG. 4 and the coaxial filter shown in FIG. 5 are connected by using their respective connector.

It should be noted that a dielectric filter and a coaxial filter used in a filtering apparatus provided by this embodiment of the present invention are not limited to structures shown in FIG. 4 and FIG. 5.

An example is used in the following to describe a design process of a filtering apparatus.

1. Design of a single-cavity dielectric filter.

Select a dielectric material used in a dielectric resonator, and adjust the thickness and diameter of the dielectric resonator according to a specified resonance frequency of 2.62 gigahertz (GHz); then install the dielectric resonator in a metal cavity, so as to form the single-cavity dielectric filter; tune the depth of a dielectric tuner, so that a resonance point of the single-cavity dielectric filter is approximately 2.62 GHz; and test the single-cavity dielectric filter by using a network analyzer to find that a second harmonic frequency point of the single-cavity dielectric filter is 2.76 GHz.

2. Design the number of dielectric filters as 7 according to the single-cavity dielectric filter and a specified passband of 2600-2620 MHz of a second-level unit.

3. Design of a first-level unit.

According to the passband of 2600-2620 MHz of the second-level unit and a far-end suppression requirement (greater than 80 dB) of the filtering apparatus, simulate that the number of coaxial filters that have a central frequency band of 2610 MHz and a bandwidth of 40 MHz, and that meet a requirement of a second harmonic frequency band is 4; calculate the size of a coupling window between the coaxial filters according to a coupling matrix; and generate a transmission zero at the frequency point of 2.76 GHz.

An electromagnetic wave is transmitted between metal cavities of the coaxial filters by means of transverse electromagnetic coupling in an arrangement direction of the coaxial filters, and a metal cavity of a coaxial filter that is arranged last is coupled, on a cavity wall, to a dielectric filter that is arranged first in the second-level unit by using a tap and a coaxial connector.

Adjust the height of the tap of the coaxial filter that is arranged last to make a reflection delay of the coaxial filter be $\pi s11=11.3$ nanoseconds (ns). The reflection delay can be obtained by calculation using a formula: a reflection delay=636.6/a coupling bandwidth.

4. Couple the coaxial filter that is arranged last in the first-level unit to the dielectric filter that is arranged first in the second-level unit by using a coupling loop.

5. Design an arrangement of the first-level unit and the second-level unit according to the overall volume of a cavity of the filtering apparatus, so as to arrange an overall layout.

6. Draw a structural design according to an arrangement layout of the cavity and the sizes of coupling windows, issue a drawing, and process the entire cavity by using a machine tool.

Each filter has a metal cavity; therefore, the cavity may be integrally formed, so as to simplify the fabrication process.

7. Assemble the processed metal cavities, coaxial filters, conductors, resonators, and a cover plate.

8. Commissioning: perform commissioning on the coaxial filters first by using tuning screws, then perform commissioning on the dielectric filters by using dielectric tuners, finally connect the filtering apparatus to the network analyzer, perform manual commissioning on the tuning screws and the dielectric tuners, adjust an S parameter to a required curve.

Figure 7:
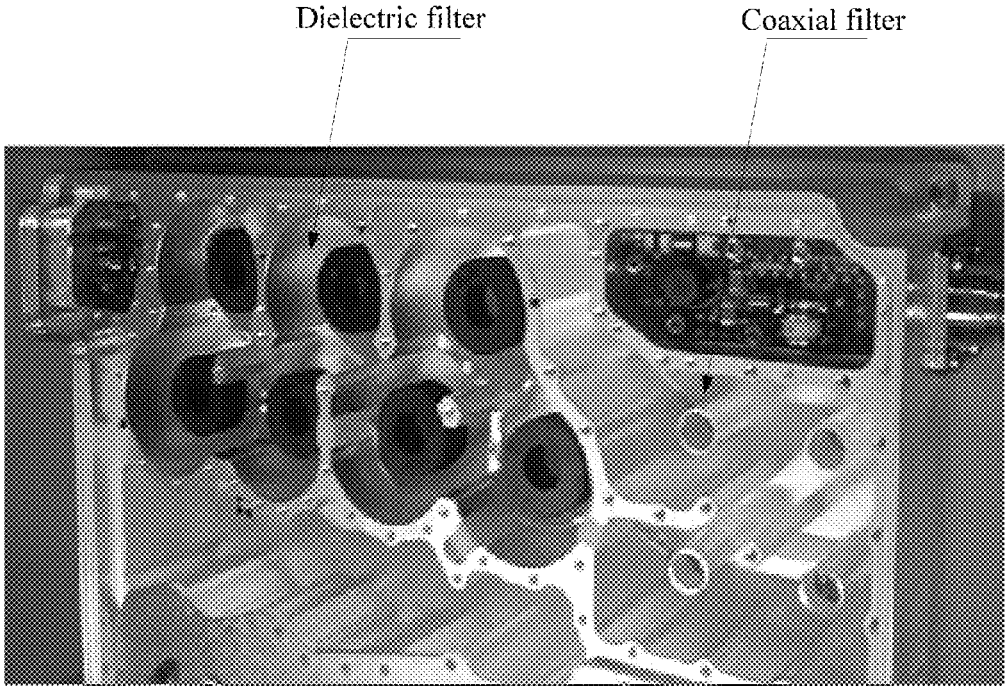
FIG. 7 is a photo of an actual filtering apparatus according to an embodiment of the present invention.

Therefore, what is designed is a filtering apparatus with a passband that exceeds 40 MHz, namely twice as large as a bandwidth of the second-level unit, and having high suppression (e.g., 80 dB) on the frequency point of 2.76 GHz. FIG. 7 is a sectional view of an actual filtering apparatus made according to the foregoing steps.

Figure 8:
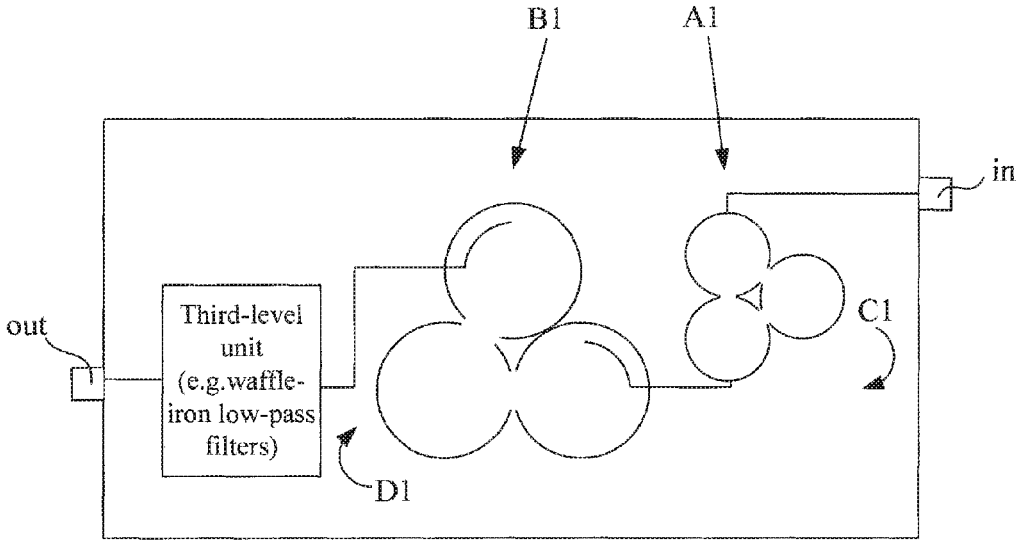
FIG. 8 is a schematic structural diagram of another filtering apparatus according to an embodiment of the present invention.

In the filtering apparatus, the coaxial filters and the dielectric filters may be arranged in various manners. An arrangement manner shown in FIG. 1 may be used, or an arrangement manner shown in FIG. 8 may also be used. A sectional shape of a metal cavity of a coaxial filter shown in FIG. 8 is circular. Different from a square or a rectangle shown in FIG. 1, the metal cavity may also be a cavity with an irregular shape. A specific sectional shape may be designed according to an overall structure of a filtering apparatus. Reference numerals in FIG. 8 that are the same as those in FIG. 1 indicate the same meaning as that in FIG. 1.

In the filtering apparatus provided in the embodiments of the present invention, a passband of a first-level unit covers a passband of a second-level unit, and a bandwidth of the first-level unit is twice the bandwidth of the second-level unit, so that when coaxial filters are coupled to dielectric filters, insertion loss of the coaxial filters is reduced, thereby reducing overall insertion loss of the filtering apparatus. By making a transmission zero of the first-level unit be located at a second harmonic frequency point of the second-level unit, the filtering apparatus can have high suppression on a second harmonic, thereby obtaining relatively desirable far-end suppression performance.

In the filtering apparatus, the second harmonic serves as a representative of a high-order harmonic wave, and by means of high suppression on the second harmonic wave, relatively desirable far-end suppression performance is obtained. However, high suppression on a third or higher harmonic wave may also be implemented. A third-level unit may be added after the second-level unit of the filtering apparatus. The third-level unit is formed by coaxial filters and is coupled to the dielectric filter that is arranged last in the second-level unit. The coupling may be coupling by using a coupling loop.

For a design and fabrication method of the third-level unit, refer to a design and fabrication method of the first-level unit, so that a transmission zero of the third-level unit is located at other high-order harmonic waves except the second harmonic wave, so as to implement high suppression on a specified high-order harmonic wave.

Existing waffle-iron low-pass filters may also be used as the third-level unit, and a stopband of the waffle-iron low-pass filters is used to implement high suppression on other high-order harmonic wave except the second harmonic wave.

The filtering apparatus provided in the embodiments of the present invention is mainly used as a duplexer of a transceiver module of a base station.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A filtering apparatus, comprising:

a first-level unit; and a second-level unit, wherein the first-level unit is formed by at least three coaxial filters, the at least three coaxial filters are arranged in sequence, each coaxial filter is coupled to an adjacent one of the at least three coaxial filters in a first arrangement direction, and two nonadjacent coaxial filters in the first arrangement direction in the at least three coaxial filters are inductively coupled to generate a transmission zero at a high frequency end of a passband of the first-level unit, wherein the second-level unit is formed by at least three dielectric filters, the at least three dielectric filters are arranged in sequence, and each dielectric filter is coupled to an adjacent one of the at least three dielectric filters in a second arrangement direction, wherein a last coaxial filter of the at least three coaxial filters in the first-level unit is coupled to a first dielectric filter of the at least three dielectric filters in the second-level unit, wherein the passband of the first-level unit covers a passband of the second-level unit, and a bandwidth of the first-level unit is twice the bandwidth of the second-level unit, and wherein the transmission zero of the first-level unit is located at a second harmonic frequency point of the second-level unit.

2. The filtering apparatus according to claim 1, wherein the last coaxial filter in the first-level unit is coupled to the first dielectric filter in the second-level unit by using a coupling loop.

3. The filtering apparatus according to claim 2, wherein the coupling loop is a silver-plated metal piece.

4. The filtering apparatus according to claim 1, wherein said each coaxial filter is coupled to the adjacent one of the at least three coaxial filters in the arrangement direction by using a coupling window.

5. The filtering apparatus according to claim 1, wherein said each dielectric filter is coupled to the adjacent one of the at least three dielectric filters in the second arrangement direction by using a coupling window.

6. The filtering apparatus according to claim 1, wherein the two nonadjacent coaxial filters in the first arrangement direction are configured to generate the transmission zero in the high frequency end of the passband of the first-level unit are coupled by using a coupling window.

7. The filtering apparatus according to claim 1, wherein any one of the at least three dielectric filters comprises a first metal cavity, a dielectric resonator fastened at the bottom of the first metal cavity, and a dielectric tuner fastened at the top of the first metal cavity, wherein the dielectric tuner is opposite to the dielectric resonator, and when the dielectric tuner moves toward the bottom or the top of the first metal cavity, the distance from the dielectric resonator is decreased or increased to adjust a resonance frequency of the dielectric resonator, and a coupling window is formed on a side wall of the first metal cavity.

8. The filtering apparatus according to claim 1, wherein any one of the at least three coaxial filters comprises a second metal cavity, a conductor that is fastened at the bottom of the second metal cavity and coaxial with the second metal cavity, and a tuning screw fastened at the top of the second metal cavity, wherein the tuning screw is opposite to the conductor, and when the tuning screw moves toward the bottom or the top of the second metal cavity, the distance from the conductor is decreased or increased to adjust a reflection delay of the coaxial filter, and a coupling window is formed on a side wall of the second metal cavity.

9. The filtering apparatus according to claim 1, further comprising a third-level unit, wherein the third-level unit is formed by coaxial filters and is coupled to a dielectric filter that is arranged last in the second-level unit.

10. The filtering apparatus according to claim 9, wherein the third-level unit comprises waffle-iron low-pass filters.

* * * * *